US010857781B2

(12) United States Patent
Rose

(10) Patent No.: US 10,857,781 B2
(45) Date of Patent: Dec. 8, 2020

(54) METHOD AND DEVICE FOR PRODUCING DOCUMENTS

(71) Applicant: Bernd Rose, Landau (DE)

(72) Inventor: Bernd Rose, Landau (DE)

( * ) Notice: Subject to any disclaimer, the term of this patent is extended or adjusted under 35 U.S.C. 154(b) by 0 days.

(21) Appl. No.: 16/472,105

(22) PCT Filed: Sep. 20, 2017

(86) PCT No.: PCT/EP2017/073789
§ 371 (c)(1),
(2) Date: Jun. 20, 2019

(87) PCT Pub. No.: WO2018/114070
PCT Pub. Date: Jun. 28, 2018

(65) Prior Publication Data

US 2020/0122452 A1 Apr. 23, 2020

(30) Foreign Application Priority Data

Dec. 21, 2016 (DE) ..... 10 2016 015 200

(51) Int. Cl.
*B41F 13/56* (2006.01)
*B41F 5/24* (2006.01)
(Continued)

(52) U.S. Cl.
CPC ..... *B41F 13/56* (2013.01); *B41F 5/24* (2013.01); *B41M 1/04* (2013.01); *B41P 2200/12* (2013.01);
(Continued)

(58) Field of Classification Search
CPC ... B41F 13/56; B41F 5/24; B41M 1/04; B41P 2200/12; B42C 19/06; B65H 39/16;
(Continued)

(56) References Cited

U.S. PATENT DOCUMENTS 4,512,845 A * 4/1985 Kobler ..... B65H 37/02 156/548
5,156,384 A * 10/1992 Donahue ..... B42C 1/00 270/58.31
(Continued)

FOREIGN PATENT DOCUMENTS

DE 2558049 A1 6/1977
DE 3226907 A1 1/1984
(Continued)

OTHER PUBLICATIONS

PCT/EP2017/073789, International Search Report, European Patent Office, dated Dec. 12, 2017.
PCT/EP2017/073789, Written Opinion of the International Searching Authority, European Patent Office, dated Dec. 12, 2017.
PCT/EP2017/073789, International Preliminary Report on Patentability, European Patent Office, dated Apr. 16, 2019.

*Primary Examiner* — Leslie A Nicholson, III
(74) *Attorney, Agent, or Firm* — Ice Miller LLP

(57) ABSTRACT

A method and a device for producing a document and a document produced in a corresponding manner are presented, said document being produced from a paper reel (1), being printed in a continuous rotary method, being divided into partial webs (4.1 to 4.4) and being assembled to form a document which is ready for use and has a plurality of sheets or pages. The thickness of individual pages or sheets of said document can be increased by the fact that a gluing machine (26) is integrated into the production process of said document, the gluing machine gluing individual page sections, individual pages or entire sheets of said document to one another. A second paper reel or second type of paper or second paper quality having a higher paper thickness or paper quality is therefore unnecessary.

23 Claims, 3 Drawing Sheets

(51) Int. Cl.

| | |
|---|---|
| *B41M 1/04* | (2006.01) |
| *B42C 19/06* | (2006.01) |
| *B65H 39/16* | (2006.01) |
| *B65H 45/28* | (2006.01) |
| *B65H 45/30* | (2006.01) |

(52) U.S. Cl.
CPC ..... *B42C 19/06* (2013.01); *B65H 39/16* (2013.01); *B65H 45/28* (2013.01); *B65H 45/30* (2013.01); *B65H 2511/512* (2013.01); *B65H 2801/21* (2013.01)

(58) Field of Classification Search
CPC .. B65H 45/28; B65H 45/30; B65H 2511/512; B65H 2801/21
USPC ..... 270/52.09
See application file for complete search history.

(56) References Cited

U.S. PATENT DOCUMENTS

| | | | | |
|---|---|---|---|---|
| 5,230,501 | A | 7/1993 | Melton | |
| 5,242,521 | A * | 9/1993 | Hibsch | B42D 15/00 156/200 |
| 8,871,047 | B2 * | 10/2014 | Hunkeler | B42C 3/00 156/200 |
| 2001/0040371 | A1 * | 11/2001 | Dahlquist | G09F 1/04 283/51 |

FOREIGN PATENT DOCUMENTS

| | | | |
|---|---|---|---|
| DE | 102014205939 | A1 | 10/2015 |
| EP | 2145773 | | 1/2010 |

* cited by examiner

METHOD AND DEVICE FOR PRODUCING DOCUMENTS

CROSS-REFERENCE TO RELATED APPLICATIONS

The present application is a U.S. national stage patent application of, and claims the priority benefit of International Patent Application Serial No. PCT/EP2017/073789, filed Sep. 20, 2017, and also claims the priority benefit of German Patent Application Serial No. 102016015200.1 filed Dec. 21, 2016, the text and drawings of which are hereby incorporated by reference in their entireties.

FIELD OF THE INVENTION

The present invention relates to a production method for documents which is intended to be produced from paper having different paper thicknesses. For example, relatively thick paper is required for the cover or the outer pages of the document while a thinner paper is intended to be used for the inner pages of the document. The invention further relates to a device for producing documents, to a document produced according to the method and to the use of an adhesive method or glue application method, preferably a flexographic printing method, for coating and for adhesively bonding mutually facing pages of a paper web to form a thickened page.

TECHNICAL BACKGROUND

The production of such documents has been relatively complicated up to now since at least two types of paper having a different paper thickness or having a different quality have to be provided. Furthermore, during this production method, two printing operations for the respectively different types of paper are required, with the pages from the first printing operation having to be temporarily stored and then the pages from the two printing operations having to be brought together and connected or stitched to one another in an additional sorting process. This complicated production process has serious consequences in view of the high cost pressure in the printing industry.

General Objective

It is an object of the present invention to permit the production of cost-effective documents which can optionally contain pages having a different thickness or rigidity and can be produced in one manufacturing operation, wherein said pages of different thickness are designed as integral components, produced in line, of the document. In addition, the pages which are thickened according to the invention are substantially more attractive in respect of look, feel and diversity in comparison to the previously known documents.

DESCRIPTION OF THE INVENTION

This object is achieved by the claimed features of the appended patent claims.

Hereinafter, the terms "have", "encompass", "comprise" or "include" or any grammatical departures therefrom are used non-exclusively. Accordingly, these terms can refer either to situations in which, besides the features introduced by these terms, no further features are present, or to situations in which one or more further features are present. By way of example, the expression "A has B", "A encompasses B", "A comprises B" or "A includes B" can refer either to the situation in which, apart from B, no further element is present in A (i.e. to a situation in which A exclusively consists of B), or to the situation in which, in addition to B, one or more further elements are present in A, for example element C, elements C and D or even further elements.

Furthermore, it is pointed out that the terms "at least one" and "one or more" and grammatical modifications of these terms, if they are used in association with one or more elements or features and are intended to express the fact that the element or feature can be provided singularly or multiply, generally are used only once, for example when the feature or element is introduced for the first time. When the feature or element is subsequently mentioned again, the corresponding term "at least one" or "one or more" is generally no longer used, without restricting the possibility that the feature or element can be provided singularly or multiply.

Furthermore, hereinafter the terms "preferably", "in particular", "for example" or similar terms are used in conjunction with optional features, without alternative embodiments being restricted thereby. In this regard, features introduced by these terms are optional features, and the scope of protection of the claims, and in particular of the independent claims, is not intended to be restricted by these features. In this regard, the invention, as will be recognized by a person skilled in the art, can also be carried out using other configurations. In a similar way, features introduced by "in one embodiment of the invention" or by "in one exemplary embodiment of the invention" are understood as optional features, without alternative configurations or the scope of protection of the independent claims being intended to be restricted thereby. Furthermore, all possibilities of combining the features introduced by these introductory expressions with other features, be they optional or non-optional features, are intended to remain unaffected by these introductory expressions.

The invention is based on a rotary printing machine which is known per se, for example a web-fed offset machine or a rotogravure printing machine. Such machines operate at relatively high speeds of, for example, 1500 pages per second. These high speeds necessitate exacting requirements of the conveying speed and the load-bearing capacity of the paper webs which may be several meters wide and have to be continuously and precisely controlled. In particular in the case of multicolor printing, there are extremely exacting requirements regarding the control of said machines since the printed images of one printing roller (color) have to correspond precisely with the printed images of the other printing rollers (colors) in order to satisfy the current high requirements demanded by customers regarding the print quality of printed products.

The term "document", as used here, is a further term to which its customary and conventional meaning, as understood by a person skilled in the art, is intended to be ascribed. The term is not limited to a special or adapted meaning. The term can relate, without limitation, in particular to a product which consists of printed writing.

The term "paper reel", as used here, is a further term to which its customary and conventional meaning, as understood by a person skilled in the art, is intended to be ascribed. The term is not limited to a special or adapted meaning. The term can relate, without limitation, in particular to a reel, roller or to another cylindrical body which carries a paper web in wound or wound-up form.

The term "paper web", as used here, is a further term to which its customary and conventional meaning, as understood by a person skilled in the art, is intended to be ascribed. The term is not limited to a special or adapted meaning. The term can relate, without limitation, in particular to an endless paper sheet which is produced on a papermaking machine.

The term "partial web", as used here, is a further term to which its customary and conventional meaning, as understood by a person skilled in the art, is intended to be ascribed. The term is not limited to a special or adapted meaning. The term can relate, without limitation, in particular to a a longitudinal section of a paper web.

The term "sheet", as used here, is a further term to which its customary and conventional meaning, as understood by a person skilled in the art, is intended to be ascribed. The term is not limited to a special or adapted meaning. The term can relate, without limitation, in particular to a uniformly, cut, in particular rectangularly cut piece of paper.

The term "page", as used here, is a further term to which its customary and conventional meaning, as understood by a person skilled in the art, is intended to be ascribed. The term is not limited to a special or adapted meaning. The term can relate, without limitation, in particular to the upper side and/or lower side of a paper sheet.

The term "fold", as used here, is a further term to which its customary and conventional meaning, as understood by a person skilled in the art, is intended to be ascribed. The term is not limited to a special or adapted meaning. The term can relate, without limitation, in particular to a sharp crease edge of a sheet of paper. Accordingly, "folding" should be understood as meaning the production of such a sharp crease edge which is produced with the aid of a tool or a machine.

The term "rotary printing machine", as used here, is a further term to which its customary and conventional meaning, as understood by a person skilled in the art, is intended to be ascribed. The term is not limited to a special or adapted meaning. The term can relate, without limitation, in particular to a machine which prints according to the printing principle round on round, that is to say both the printing forme and the counterpressure are cylindrical. The two cylinders are in a continuous, opposed movement and are separated from each other only by the printing material. A rotary printing machine is suitable for gravure printing, letter press printing or flexographic printing and flat printing.

The term "selective coating", as used here, is a further term to which its customary and conventional meaning, as understood by a person skilled in the art, is intended to be ascribed. The term is not limited to a special or adapted meaning. The term can relate, without limitation, in particular to a coating or to undertaking coating in selected regions or sections of an object. For example, a selective coating of a page with adhesive means that the page is coated in selected regions or sections with adhesive. The adhesive can be applied here to the page in a predetermined pattern.

The term "adhesive", as used here, is a further term to which its customary and conventional meaning, as understood by a person skilled in the art, is intended to be ascribed. The term is not limited to a special or adapted meaning. The term can relate, without limitation, in particular to a material which is suitable for connecting the joining partners in an integrally bonded manner by means of adhesion, i.e. adhering by physical and/or chemical interactions.

The term "printing plate", as used here, is a further term to which its customary and conventional meaning, as understood by a person skilled in the art, is intended to be ascribed. The term is not limited to a special or adapted meaning. The term can relate, without limitation, in particular to a printing forme for letter press printing, said printing forme being produced photo-chemically, mechanically by means of laser exposure or manually. A printing forme is an object with which a substance is transferred to a print substrate, such as, for example, paper. Letter press printing is a mechanical printing method. The printing parts are raised on the print substrate while the non-printing parts lie in a recessed manner.

The term "anilox roller", as used here, is a further term to which its customary and conventional meaning, as understood by a person skilled in the art, is intended to be ascribed. The term is not limited to a special or adapted meaning. The term can relate, without limitation, in particular to a roller which is a storage medium which is intended to constantly provide a necessary and defined quantity of substance to be transferred which here is in particular adhesive, during the printing operation. Minutely small, uniform cups or cells, what are referred to as domes, and sometimes also lines (hachure) which are engraved using various gravure methods are located on the surface of the roller, which can be composed of ceramic or chrome. The non-recessed points are called webs, the depressions generally cups. In the present invention, the application of (adhesive) substance takes place via a chambered doctor blade system. The anilox roller surface, i.e. the webs, is freed from protruding (adhesive) substance with the aid of an opposed doctor blade. A defined and therefore controllable quantity of (adhesive) substance therefore remains only in the depressions. The anilox roller transfers the (adhesive) substance onto the next roller or, as in flexographic printing, directly onto the printing plate by the depressions always being emptied uniformly. However, the emptying is never complete, and flushing of (adhesive) substance within the cups takes place during each rotation of the roller. By means of the rotation of the anilox roller and the associated uniform picking up and removal of (adhesive) substance, the surface is supplied with a defined and reproducible volume of (adhesive) substance.

The term "chambered doctor blade system", as used here, is a further term to which its customary and conventional meaning, as understood by a person skilled in the art, is intended to be ascribed. The term is not limited to a special or adapted meaning. The term can relate, without limitation, in particular to a system in which the excess (adhesive) substance to be printed is scraped off from the anilox roller surface by a doctor blade. However, in this method, the (adhesive) substance is pumped into a chamber which presses tightly against the anilox roller by means of air pressure and which contains doctor blades. Doctor blades are conventionally composed of steel, variants are plastics doctor blades and ceramic-coated steel doctor blades.

The term "flexographic printing method", as used here, is a further term to which its customary and conventional meaning, as understood by a person skilled in the art, is intended to be ascribed. The term is not limited to a special or adapted meaning. The term can relate, without restriction, in particular to a direct letter press printing method. Flexographic printing is more precisely a web-fed rotary printing method using flexible printing plates, which are composed of photopolymer or rubber, and the (adhesive) substance to be printed.

A method proposed according to the invention for producing a document comprises the following steps: a paper web is removed from a paper reel, said paper web is conveyed continuously, is printed using a rotary printing machine and is subsequently separated into at least two partial webs, wherein at least one first partial web is displaced in the transverse direction and is assigned to a second partial web lying thereabove or therebelow in such a manner that in each case a section of the first partial web together with a section of the second partial web form at least two sheets of the document that are subsequently cut to size, are folded longitudinally or transversely approximately centrally, are connected to one another and can be folded to form a document having at least eight pages, at least one page of the first partial web is coated at least selectively with adhesive and is adhesively bonded to at least one facing page of the second partial web to form a thickened page. The thickened page correspondingly has a thickness which is at least double the size of the thickness of a non-adhesively-bonded page. It goes without saying that the applied adhesive may additionally increase the thickness of the adhesively bonded pages. All of the method steps here can be carried out in a single device, and therefore the method can be carried out automatically.

In one development, only one page section of the document is thickened and is formed from a page section of the first partial web and a facing page section of the second partial web, which page sections are adhesively bonded to each other. The pages correspondingly do not have to be adhesively bonded to one another over the full surface. For example, the pages can be adhesively bonded to one another in such a manner that they form a type of pocket.

In one development, only one page section of the document consists of adhesively bonded pages or adhesively bonded page sections. For example, only the first, last or any other page of the document is produced from adhesively bonded pages or page sections. Accordingly, the method permits a flexible formation of thickened pages of the document.

In one development, the first page and the last page of the document consist of oppositely adhesively bonded pages. As a result, a type of cover or binding of the document can be produced.

In one development, individual surface regions of a page to be adhesively bonded are not coated with adhesive, and the opposite page is designed in the manner of an advent calendar with perforated window sections which can be opened manually. Accordingly, the thickened page can be configured flexibly or as desired.

In one development, directly after the adhesive bonding process, at least one adhesively bonded page is provided with a concave and/or convex embossing in the form of letterings and/or pictorial illustrations.

In one development, fibrous materials are added to the adhesive. As a result, the thickened page can additionally be stabilized at the adhesive bond.

In one development, thickening fillers are added to the adhesive. As a result, the thickened page can be additionally thickened, which can further improve the haptic properties.

In one development, the page of the first partial web and the facing page of the second partial web are unprinted. In other words, only pages printed on one side are adhesively bonded to one another, wherein the adhesive bond takes place at the unprinted locations.

In one development, two consecutive pages of the first partial web are coated at least selectively with adhesive and are adhesively bonded to two consecutive, facing pages of the second partial web to form a thickened double page, wherein the two pages of the first partial web and the two pages of the second partial web are unprinted. Accordingly, thickened double pages can be realized.

In one development, the unprinted page of the first partial web and the unprinted, facing page of the second partial web are detected automatically. As a result, printed pages and unprinted pages can be differentiated from one another and the adhesive bond can take place flexibly or on any desired pages.

In one development, the unprinted page of the first partial web and the unprinted, facing page of the second partial web are automatically detected by means of a marking on the first partial web and the second partial web. Such a marking can be simply detected visually.

In one development, the page of the first partial web is coated selectively with adhesive within the region of the fold of the document and additionally in at least one region outside the fold. Accordingly, an adhesive bond can not only be provided in the region of the fold, but also at any desired position outside same. The adhesive for the fold can differ here from the adhesive at the regions outside thereof in respect at least of one property, such as, for example, the viscosity.

In one development, the page of the first partial web is coated with adhesive and adhesively bonded to the facing page of the second partial web to form a thickened page in such a manner that the page of the first partial web is immovable relative to the facing page of the second partial web. This can take place in particular in such a manner that the page of the first partial web cannot be turned relative to the facing page of the second partial web. Accordingly, after the adhesive bonding, the pages of the first and second partial web can be turned exclusively together in the manner of a single, thickened page.

In one development, three or more pages of the partial webs are adhesively bonded to one another. As a result, the thickness of the adhesively bonded page can be increased or adjusted as desired.

The invention furthermore proposes a document which is produced from a paper reel, is printed, is separated into at least two partial webs and the latter are assigned to one another in such a manner that in each case a section of the first partial web together with a section of the second partial web form a plurality of sheets of a document that are cut to size, are folded longitudinally or transversely approximately centrally, are connected and are folded to form a multi-page document. At least one page of a first partial web is adhesively bonded at least selectively to an opposite page of the second partial web and forms at least one thickened page and/or a thickened page section of the document.

The invention furthermore proposes a device for producing a document. The device comprises a removal device for removing a paper web from a paper reel, a conveying device for continuously conveying the paper web, a rotary printing machine for printing the paper web, a separating device for separating the printed paper web into at least two partial webs, a guide device for displacing at least one first partial web in the transverse direction and for assigning the first partial web to a second partial web lying thereabove or therebelow in such a manner that in each case a section of the first partial web together with a section of the second partial web form at least two sheets of the document, a cutting device for cutting the sheets to size, a folding device for folding the sheets longitudinally or transversely approximately centrally, and a connecting device for connecting the sheets to one another to form a document which can be folded with at least eight pages. The device furthermore has at least one gluing machine which is designed for coating at least one page of the first partial web at least selectively with adhesive and for adhesive bonding to at least one facing page of the second partial web to form a thickened page. Accordingly, only one single device is required in order to produce a document which is formed from a plurality of pages and has at least one thickened page. The production process can thereby be substantially or fully automated. Production costs for documents can therefore be reduced.

In one development, the gluing machine has a glue application roller which is designed for selectively loading an upper side or lower side of the first partial web with adhesive, and a transfer roller which is designed for transferring the adhesive from an adhesive source to the glue application roller in a predetermined pattern. The adhesive can therefore be applied in a simple and fully automatable manner. Alternatively, the adhesive can be applied to the upper side or lower side of the first partial web by means of an intermittently connected nozzle.

In one development, the glue application roller has a printing plate and the transfer roller is an anilox roller. A precisely defined quantity of adhesive can be transferred to the glue application roller by means of the anilox roller. The printing plate here defines the selective application of adhesive to the page of the first partial web. The printing plate in particular predetermines a certain pattern with locations which are coated with adhesive.

In one development, the gluing machine furthermore has an impression roller, wherein the impression roller is designed for guiding the first partial web past the glue application roller in such a manner that the first partial web can be coated with adhesive by means of the glue application roller. Accordingly, the guiding of the first partial web and the coating with adhesive take place in a compact design.

In one development, the glue application roller and the impression roller are rotatable in an opposed manner. As a result, supplying of the first partial web with the selective adhesive coating can be particularly readily synchronized.

In one development, the gluing machine furthermore has a chambered doctor blade system with a chamber and at least one doctor blade arranged in the chamber, wherein the chambered doctor blade system is designed for applying adhesive to the transfer roller and for scraping excess adhesive from the transfer roller. The selective adhesive coating can thereby be automated in a simple manner.

In one development, the device furthermore has a detection device, wherein the detection device is designed for automatically detecting an unprinted page of the first partial web, wherein the gluing machine is designed for selectively loading the detected unprinted page of the first partial web with adhesive. Therefore, an unprinted page can be detected, for example visually detected, in an automated manner, and only said unprinted page can be selectively coated with adhesive.

The present invention furthermore relates to the use of a flexographic printing method for selectively coating at least one page of a first partial web of a paper web with adhesive and for adhesively bonding to at least one facing page of a second partial web of the paper web to form a thickened page of a document with at least eight foldable pages.

In one development, the page of the first partial web and the facing page of the second partial web are unprinted.

In summary, without restricting further possible configurations, the following embodiments are proposed:

Embodiment 1

A method for producing documents, wherein a paper web is removed from a paper reel, said paper web is conveyed continuously, is printed using a rotary printing machine and is subsequently separated into at least two partial webs, wherein at least one first partial web is displaced in the transverse direction and is assigned to a second partial web lying thereabove or therebelow in such a manner that in each case a section of the first partial web together with a section of the second partial web form at least two sheets of the document that are subsequently cut to size, are folded longitudinally or transversely approximately centrally, are connected to one another and can be folded to form a document having at least eight pages, wherein at least one page of the first partial web is coated at least selectively with adhesive and is adhesively bonded to at least one facing page of the second partial web to form a thickened page.

Embodiment 2

The method according to embodiment 1, characterized in that only one page section of the document is thickened and is formed from a page section of the first partial web and a facing page section of the second partial web, which page sections are adhesively bonded to each other.

Embodiment 3

The method according to at least one of the preceding embodiments, characterized in that only one page of the document consists of adhesively bonded pages or adhesively bonded page sections.

Embodiment 4

The method according to at least one of the preceding embodiments, characterized in that the first page and the last page of the document consist of oppositely adhesively bonded pages.

Embodiment 5

The method according to at least one of the preceding embodiments, characterized in that individual surface regions of a page to be adhesively bonded are not coated with adhesive, and the opposite page is designed in the manner of an advent calendar with perforated window sections which can be opened manually.

Embodiment 6

The method according to at least one of the preceding claims, characterized in that, directly after the adhesive bonding process, at least one adhesively bonded page is provided with a concave and/or convex embossing in the form of letterings and/or pictorial illustrations.

Embodiment 7

The method according to at least one of the preceding embodiments, characterized in that fibrous materials are added to the adhesive.

Embodiment 8

The method according to at least one of the preceding embodiments, characterized in that thickening fillers are added to the adhesive.

Embodiment 9

The method according to at least one of the preceding embodiments, characterized in that the page of the first partial web and the facing page of the second partial web are unprinted.

Embodiment 10

The method according to at least one of the preceding embodiments, characterized in that two consecutive pages of the first partial web are coated at least selectively with adhesive and are adhesively bonded to two consecutive, facing pages of the second partial web to form a thickened double page, wherein the two pages of the first partial web and the two pages of the second partial web are unprinted.

Embodiment 11

The method as claimed in either of the two preceding claims, characterized in that the unprinted page of the first partial web and the unprinted, facing page of the second partial web are detected automatically.

Embodiment 12

The method according to the preceding embodiment, characterized in that the unprinted page of the first partial web and the unprinted, facing page of the second partial web are automatically detected by means of a marking on the first partial web and the second partial web.

Embodiment 13

The method according to at least one of the preceding embodiments, characterized in that the page of the first partial web is coated selectively with adhesive within the region of the fold of the document and additionally in at least one region outside the fold.

Embodiment 14

The method according to at least one of the preceding embodiments, characterized in that the page of the first partial web is coated with adhesive and adhesively bonded to the facing page of the second partial web to form a thickened page in such a manner that the page of the first partial web is immovable, in particular cannot be turned, relative to the facing page of the second partial web.

Embodiment 15

The method according to at least one of the preceding embodiments, characterized in that a total of three or more pages of the first partial web and of the second partial web are adhesively bonded to one another to form a thickened page.

Embodiment 16

A document having the features according to at least one of the preceding embodiments, which is produced from a paper reel, is printed, is separated into at least two partial webs and the latter are assigned to one another in such a manner that in each case a section of the first partial web together with a section of the second partial web form a plurality of sheets of a document that are cut to size, are folded longitudinally or transversely approximately centrally, are connected and are folded to form a multi-page document, wherein at least one page of a first partial web is adhesively bonded at least selectively to an opposite page of the second partial web and forms at least one thickened page and/or a thickened page section of the document.

Embodiment 17

A device for producing documents, comprising a removal device for removing a paper web from a paper reel, a conveying device for continuously conveying the paper web, a rotary printing machine for printing the paper web, a separating device for separating the printed paper web into at least two partial webs, a guide device for displacing at least one first partial web in the transverse direction and for assigning the first partial web to a second partial web lying thereabove or therebelow in such a manner that in each case a section of the first partial web together with a section of the second partial web form at least two sheets of the document, a cutting device for cutting the sheets to size, a folding device for folding the sheets longitudinally or transversely approximately centrally, a connecting device for connecting the sheets to one another to form a document which can be folded with at least eight pages, wherein the device has at least one gluing machine which is designed for coating at least one page of the first partial web at least selectively with adhesive and for adhesively bonding to at least one facing page of the second partial web to form a thickened page.

Embodiment 18

The device according to the preceding embodiment, characterized in that the gluing machine has a glue application roller which is designed for selectively loading an upper side or lower side of the first partial web with adhesive, and a transfer roller which is designed for transferring the adhesive from an adhesive source to the glue application roller in a predetermined pattern.

Embodiment 19

The device according to the preceding embodiment, characterized in that the glue application roller has a printing plate, wherein the transfer roller is an anilox roller.

Embodiment 20

The device according to the preceding embodiment, characterized in that the gluing machine furthermore has an impression roller, wherein the impression roller is designed for guiding the first partial web past the glue application roller in such a manner that the first partial web can be coated with adhesive by means of the glue application roller.

Embodiment 21

The device according to the preceding embodiment, characterized in that the glue application roller and the impression roller are rotatable in an opposed manner.

Embodiment 22

The device according to the preceding embodiment, characterized in that the gluing machine furthermore has a chambered doctor blade system with a chamber and at least one doctor blade arranged in the chamber, wherein the chambered doctor blade system is designed for applying adhesive to the transfer roller and for scraping excess adhesive from the transfer roller.

Embodiment 23

The device according to at least one of the preceding embodiments, characterized in that the device furthermore has a detection device, wherein the detection device is designed for automatically detecting an unprinted page of the first partial web, wherein the gluing machine is designed for selectively loading the detected unprinted page of the first partial web with adhesive.

Embodiment 24

The use of an adhesive application method, in particular a flexographic printing method, for selectively coating at least one page of a first partial web of a paper web with adhesive and for adhesively bonding to at least one facing page of a second partial web of the paper web to form a thickened page of a document with at least eight foldable pages.

Embodiment 25

The use according to the preceding embodiment, characterized in that the page of the first partial web and the facing page of the second partial web are unprinted.

BRIEF DESCRIPTION OF THE FIGURES

Further details and features will emerge from the description below of exemplary embodiments, in particular in conjunction with the dependent claims. Here, the respective features may be realized on their own or together in combination with one another. The invention is not limited to the exemplary embodiments. The exemplary embodiments are schematically illustrated in the figures. The same reference numerals in the individual figures thereby designate elements that are the same or functionally the same or correspond to one another with regard to their functions.

In detail.

DESCRIPTION OF THE EXEMPLARY EMBODIMENTS

Figure 1:
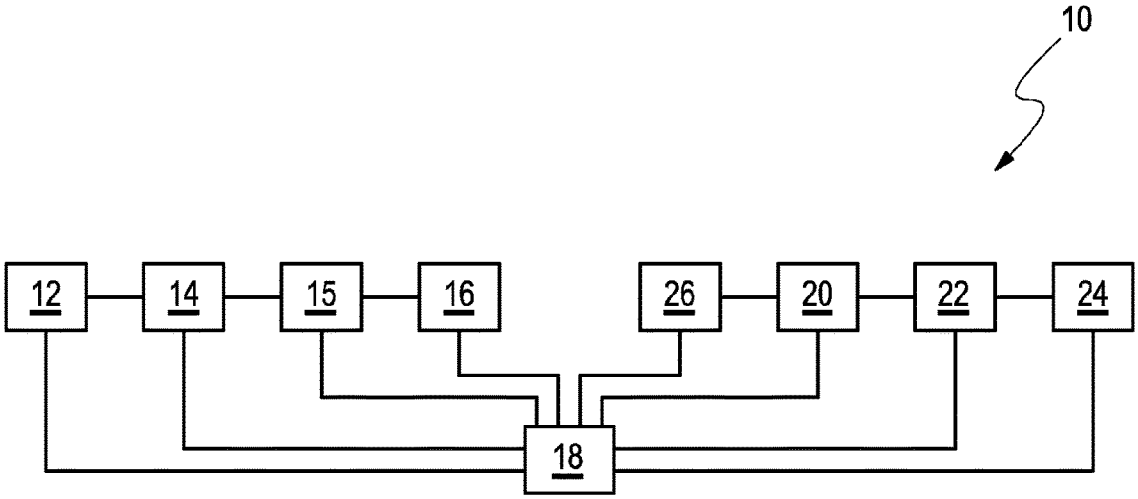
FIG. 1 shows a schematic illustration of a device for producing a document.

FIG. 1 shows a schematic illustration of a device 10 for producing a document. Further details of the device 10 are illustrated in FIGS. 2 to 5. The device 10 comprises a removal device 12 for removing a paper web 2 from a paper reel 1. The removal device 12 is, for example, a double roller (not shown specifically) with two rollers rotating in an opposed manner. The device 10 furthermore comprises a conveying device 14 for continuously conveying the paper web 2. The conveying device 14 comprises, for example, rotating rollers which convey the paper web. The device 10 furthermore comprises a rotary printing machine 15 for printing the paper web 2. The device 10 furthermore comprises a separating device 16 for separating the printed paper web 2 into at least two partial webs 4. The device 10 furthermore comprises a guide device 18 for displacing at least one first partial web 4.1 in the transverse direction and for assigning the first partial web to a second partial web 4.2 lying thereabove or therebelow in such a manner that in each case a section of the first partial web 4.1 together with a section of the second partial web 4.2 form at least two sheets of the document. The device 10 furthermore comprises a cutting device 20 for cutting the sheets to size. The device 10 furthermore comprises a folding device 22 for folding the sheets longitudinally or transversely approximately centrally. The device 10 furthermore comprises a connecting device 24 for connecting the sheets to one another to form a document which can be folded with at least eight pages. The device 10 has at least one gluing machine 26 which is designed for coating at least one page of the first partial web 4.1 at least selectively with adhesive 7 and for adhesive bonding to at least one facing page of the second partial web 4.2 to form a thickened page.

The following exemplary embodiment is illustrated in more detail in FIGS. 2 to 5 and relates to a printing machine which is configured for printing four parallel partial webs 4.1 to 4.4. Of course, such a printing machine can also be configured for a greater or smaller number of partial webs. Furthermore, variations in the manufacturing sequence of the document according to the invention are readily possible.

Figure 2:
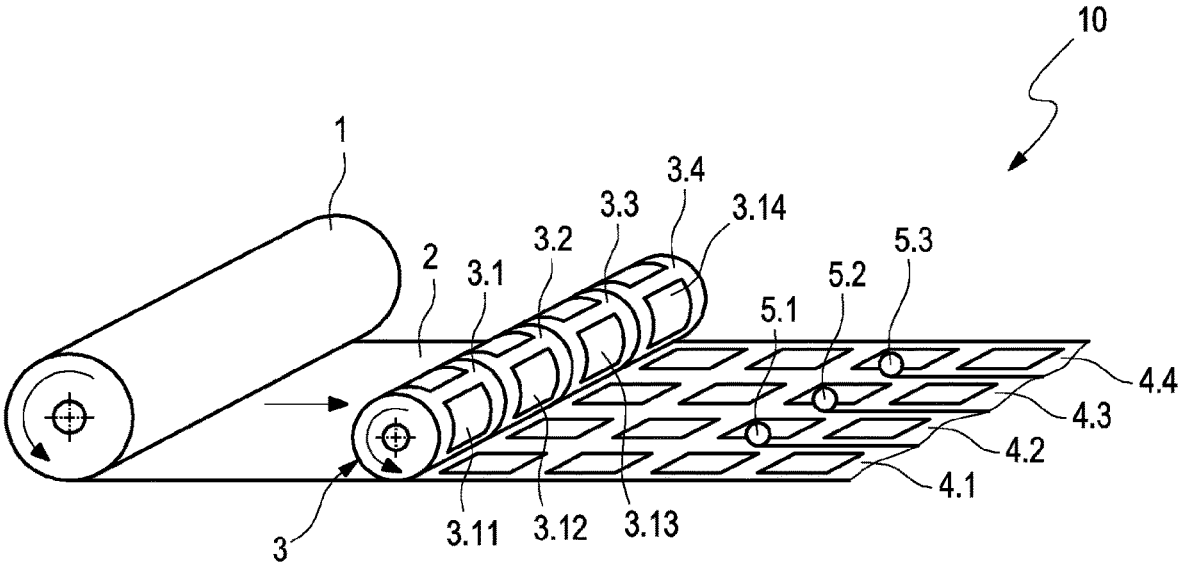
FIG. 2 shows a perspective view of part of a device for producing a document.

FIG. 2 shows a perspective view of part of such a device for producing a document. The manufacturing sequence of the known documents takes place customarily in that the paper 2 to be printed is unrolled from a paper reel 1 and is conveyed overall continuously through the entire system. The paper web is first of all printed in a customary manner by one or more printing rollers 3 of the rotary printing machine 15. On such a printing roller, numerous printing masks 3.11, inter alia, which are distributed radially over the circumference are formed, the dimensions of which is in each case assigned to one page of the document. Said printing masks are firstly distributed in the form of radial strips 3.1, inter alia, over the circumference of a printing roller 3 and can additionally form a plurality of parallel sections 3.11 to 3.14 in the longitudinal direction of the printing rollers. During the printing of the paper web, the printing masks produce partial webs 4.1 to 4.4 which are printed in parallel on the paper webs and are subsequently separated from one another in the longitudinal direction by means of blades 5.1 to 5.3, which are part of the separating device 16, and are conveyed further in the form of separate partial webs 4.1 to 4.4.

Figure 3:
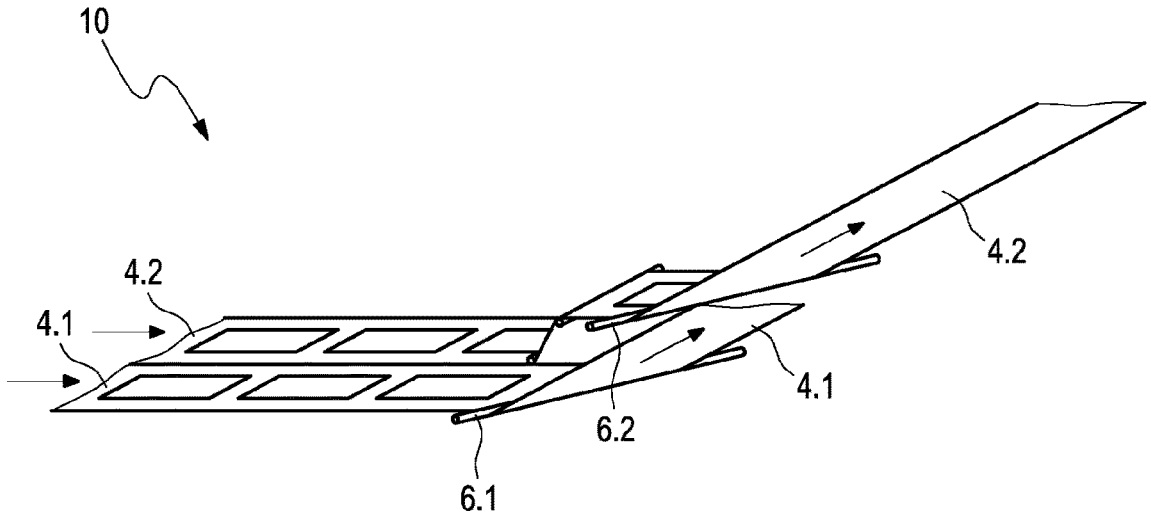
FIG. 3 shows a perspective view of a further part of the device for producing a document.

FIG. 3 shows a perspective view of a further part of the device for producing a document. The conveying direction of these separate partial webs is now rotated by ninety degrees with the aid of turning rods 6.1, 6.2, which are part of the guide device 18, and displaced here in the transverse direction with respect to one another in such a manner that the partial webs come to lie above or below one another in a predetermined manner. It is noted that only two turning rods 6.1, 6.2 are shown by way of example in FIG. 3 since FIG. 3 shows merely the two partial webs 4.1 and 4.2 to be adhesively bonded to each other. However, more than two turning rods 6.1, 6.2 can be provided if this is required for deflecting the partial webs. For example, at least two turning rods can be provided for each partial web. The skill of the printer consists in coordinating the arrangement of the printing masks on the printing rollers and the arrangement of the turning rods and optionally of other deflecting rolls with one another in such a manner that the individual sheets are logically assigned to the document and the pages of the document appear in the desired sequence. The assigned sheets are subsequently stitched, folded and cut into shape in the customary manner.

Figure 4:
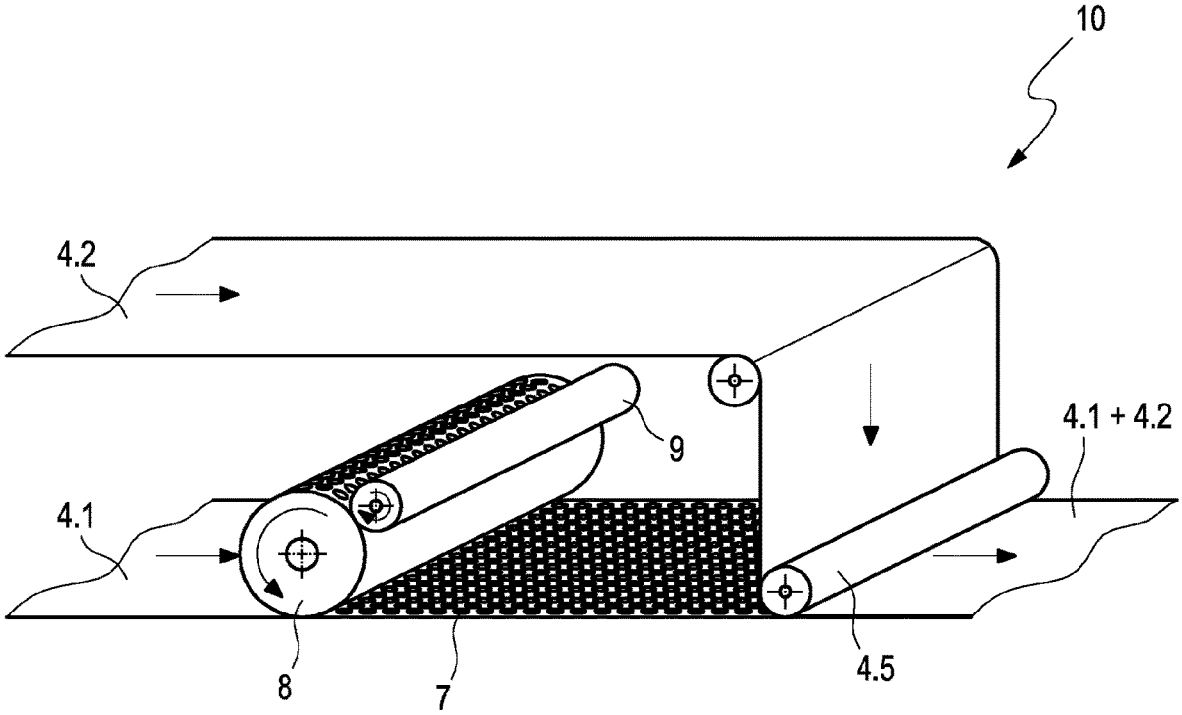
FIG. 4 shows a perspective view of a further part of the device for producing a document.

FIG. 4 shows a perspective view of a further part of the device for producing a document. The invention now consists in that a gluing machine is arranged downstream of the turning of the partial webs, said gluing machine being able to provide either a single section or else a plurality of sections of a partial web with a glue layer 7 every so often and selectively. For this purpose, said gluing machine is assigned a glue application roller 8 which can basically load a section of a partial web on the lower side or upper side with a glue layer which can be limited in terms of time and space. In order to achieve this aim, it is possible for just one circumferential section of the glue application roller to be loaded with adhesive. The quantity of glue to be applied can be adjusted via a particular structure of the surface of the glue application roller, the material thereof and/or via a separate transfer roller 9.

After the gluing, the partial webs are brought together in the known manner, at reference sign 4.5, such that the individual partial webs 4.1 and 4.2 of the document come to lie above one another or one below another in a predetermined manner. The glued surfaces of a page or of a sheet are inevitably adhesively bonded here to the assigned pages or sheets of the document, which can optionally be assisted by a pressing device, by heating and/or by selection of a rapidly curing glue. Subsequently, completion of the document takes place in the customary manner, as described above.

In a refinement of the invention, an individual page of the document can also be only partially thickened, for example only in an edge region. The connection to the remaining, namely non-adhesively-bonded page region can then be opened manually, for example via a zip perforation, which can increase the reader's attention to said document. Thickened pages may be advantageous both for forming the outer pages of a document, said pages forming an integral cover, but also for forming individual pages within a document if said pages are intended to be particularly emphasized in the form of "stop pages". Furthermore, an embossing can be introduced in a particularly simple manner into a glued page, especially whenever the glue still behaves plastically. To stiffen said embossing, fibers, for example glass fibers or mineral fibers, can also be introduced into the glue. Furthermore, small plastic balls or glass balls, optionally hollow balls, of different diameters, can be added to the glue and are capable of further increasing the thickness of the adhesively bonded pages and keep the use of glue within limits.

Figure 5:
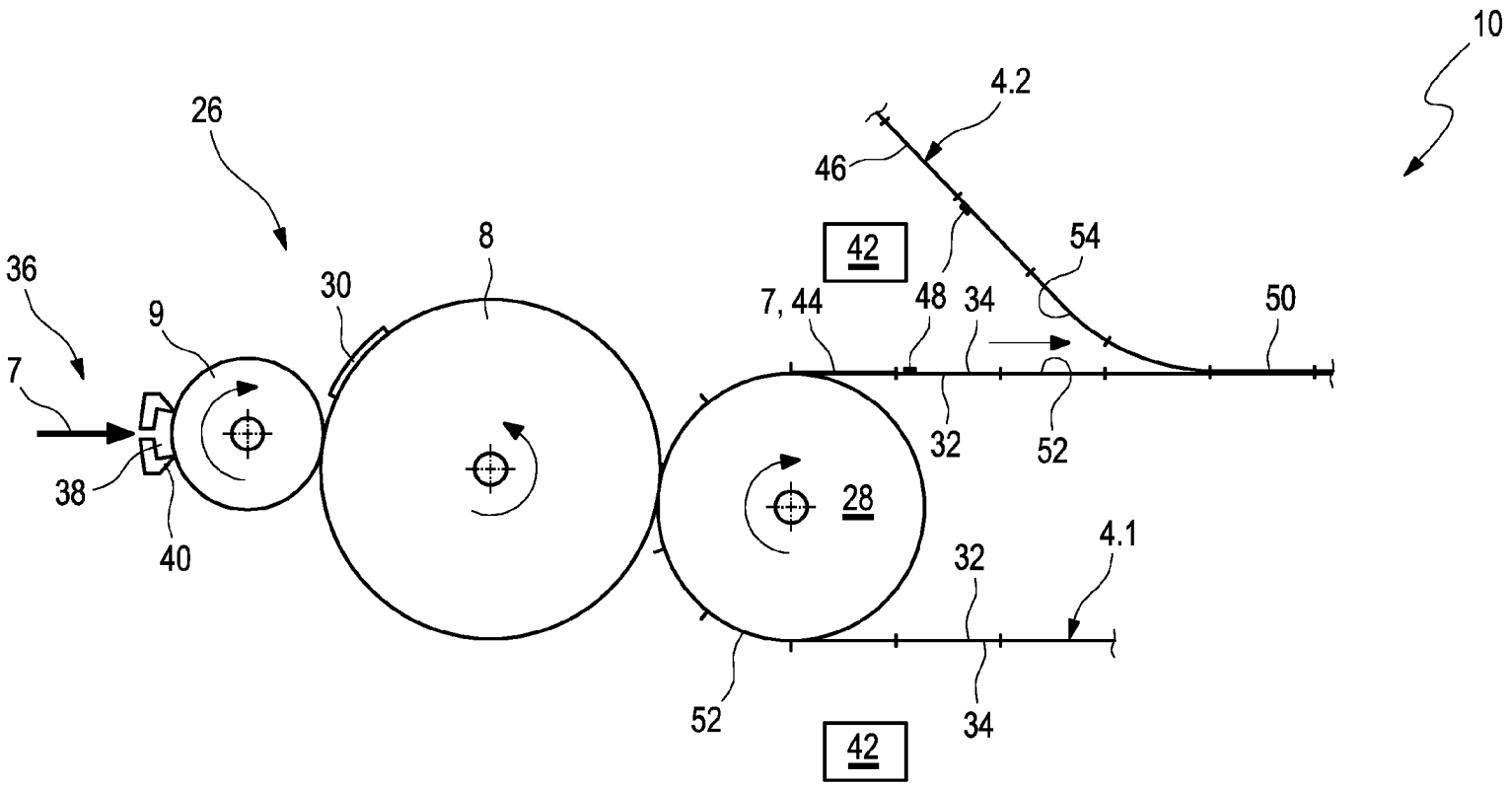
FIG. 5 shows a side view of a gluing machine of the device for producing a document.

FIG. 5 shows a side view of a gluing machine 26 of the device 10 for producing a document. The gluing machine 26 has a glue application roller 8, a transfer roller 9 and an impression roller 28. The glue application roller 8 has a printing plate 30. The glue application roller 8 is designed for selectively loading an upper side 32 or a lower side 34 of the first partial web 4.1 with adhesive 7. The transfer roller 9 is designed for transferring the adhesive 7 from an adhesive source onto the glue application roller 8 in a predetermined pattern. For this purpose, the transfer roller 9 is an anilox roller. The impression roller 28 is designed in order to guide the first partial web 4.1 past the glue application roller 8 in such a manner that the first partial web 4.1 can be coated with adhesive 7 by means of the glue application roller 8. For this purpose, the glue application roller 8 and the impression roller 28 are rotatable in an opposed manner.

The gluing machine 26 furthermore has a chambered doctor blade system 36 with a chamber 38 and at least one doctor blade 40 arranged in the chamber 38. The chambered doctor blade system 36 is designed for applying adhesive 7 to the transfer roller 9 and for scraping excess adhesive 7 from the transfer roller 9. The device 10 furthermore has a detection device 42. The detection device 42 is designed for automatically detecting an unprinted page 44 of the first partial web 4.1. The gluing machine 26 is designed for selectively loading the detected unprinted page 44 of the first partial web 4.1 with adhesive 7, as will be described in more detail below. Furthermore, the detection device 42 is designed for automatically detecting an unprinted page 46 of the second partial web 4.2. The detection device 42 can detect, for example, a marking 48 on the first partial web 4.1 and the second partial web 4.2, said marking indicating a following unprinted page 44, 46, as seen in the conveying direction. For example, the detection device 42 is a camera or a laser detector which detects a line as the marking 48.

The gluing machine 26 can be modified as follows. The glue application roller 8 can be a gravure printing roller. In this case, the transfer roller 9 can be omitted. Instead of the chambered doctor blade system 36, the adhesive 7 can be applied directly onto the first partial web 4.1 by means of an intermittently rapidly connected nozzle which points in the direction of the roller 28.

It will be described in detail below how, by means of a flexographic printing method, a thickened page 50 of a document having at least eight foldable pages can be produced. As described previously with respect to FIGS. 2 to 4, the paper web 2 is separated into partial webs 4.1 to 4.4 and printed by means of the rotary printing machine 3. The flexographic printing method for adhesively bonding sections of the partial webs 4.1 to 4.4 will be described below with reference to the first partial web 4.1 and second partial web 4.2. However, the following explanations apply analogously to the third partial web 4.3 and fourth partial web 4.4. The first partial web 4.1 is printed in such a manner that there are sections which finally form the individual pages of the document to be produced. The first partial web 4.1 is printed in such a manner that there are sections printed on two sides, i.e. sections printed on the upper side 32 and the lower side 34, and sections printed on one side, i.e. sections printed only on the lower side 34. The sections printed on one side, on the upper side 32, form at least one unprinted page 44 of the first partial web 4.1. The sections printed on double sides form pages 52 printed on both sides. The unprinted page 44 of the first partial web 4.1 here is a double page, i.e. two consecutive pages. Corresponding sections are provided analogously on the second partial web 4.2, and therefore the latter also has at least one unprinted page 46 which is likewise a double page here, i.e. two consecutive pages. Those sections of the second partial web 4.2 which are printed on double sides likewise form pages 54 printed on both sides. The marking 48 is in each case printed on upstream of the unprinted page 44, 46, as seen in the conveying direction. The detection device 42 detects said markings 48. The first partial web 4.1 is now supplied to the gluing machine 26. The gluing machine rotates the transfer roller 9, the glue application roller 8 and the impression roller 28 in opposed directions. Adhesive 7 is supplied to the chamber 38 of the chambered doctor blade system 36. The chambered doctor blade system 36 applies the adhesive 7 from the chamber 38 onto the transfer roller 9. The transfer roller 9 in turn transfers the adhesive 7 during rotation onto the printing plate 30 of the glue application roller 9. The device 10 synchronizes the rotation of the glue application roller 9 in such a manner that the printing plate 30 makes contact with the unprinted page 44 of the first partial web 4.1 when the first partial web 4.1 is guided past the glue application roller 9 via the impression roller 28. The unprinted page 44 is thereby selectively coated with adhesive 7, i.e. in a pattern predetermined by the printing plate 30. The adhesive 7 is coated here in at least one region outside a fold which has yet to be formed in the document to be produced. In the present exemplary embodiment, the adhesive 7 is applied distributed over the entire surface of the unprinted page 44 of the first partial web 4.1. Excess adhesive 7 on the transfer roller 9 is scraped off the latter by means of the doctor blade 40 and thus supplied again to the chamber 38. The page 52 printed on two sides is not contacted by the printing plate 30 and therefore is not coated with adhesive 7. The first partial web 4.1 with the selectively applied adhesive 7 on the unprinted page 44 is then conveyed further. The detection device 42 detects the unprinted page 46 of the second partial web 4.2. The device 10 conveys and synchronizes the second partial web 4.2 in such a manner that the page 44 of the first partial web 4.1, which page is unprinted and is coated with adhesive 7, faces the unprinted page 46 of the second partial web 4.2 and said pages precisely overlap one another. The first partial web 4.1 and the second partial web 4.2 are in particular guided in such a manner that the page 44 of the first partial web 4.1, which page is unprinted and is coated with adhesive 7, contacts the unprinted page 46 of the second partial web 4.2. For example, the first partial web 4.1 and the second partial web 4.2 are pressed onto each other by means of contact pressure rollers (not shown specifically). The pages 44 and 46 are thereby adhesively bonded to form a thickened page 50. Since the adhesive 7 is applied distributed over the entire surface of the unprinted page 44 of the first partial web 4.1, the pages 44, 46 are adhesively bonded to each other over the full surface. By contrast, the pages 52 and 54 which are printed on both sides lie loosely on one another.

The cutting to size, the folding longitudinally or transversely approximately centrally and the interconnection of the sections of the first partial web 4.1 and 4.2 subsequently then takes place, and therefore said sections form at least two sheets of the document. The connection can take place here by means of fold gluing and optionally additionally by means of stitching. The fold glue can differ here from the adhesive 7 in respect of the viscosity. By means of the above-described adhesive bonding of the unprinted pages 44 and 46, the latter are immovable relative to each other in the document and in particular cannot be turned counter to each other. It is explicitly emphasized that adhesive or glue is likewise applied in a manner known per se in the region of the fold.

The adhesive 7 can be applied at any desired location of the first partial web 4.1 by means of the gluing machine 26. This is realized by the shape of the printing plate 30 and the adjustment of the rotational position of the glue application roller 9. For example, a double page is not adhesively bonded over the full surface, but rather only one page of the double page. It is also possible for only one page section of the document to be thickened and to be formed from a page section of the first partial web and a facing page section of the second partial web, said page sections being adhesively bonded to each other. The sections of the partial webs can also be adhesively bonded to one another in such a manner that two facing pages form a pocket therebetween and are therefore adhesively bonded to each other only in the region of the outer edge. In principle, the thickened page 50 can be realized at any desired position within the document. For example, a thickened page 50 is provided as the first and/or last page of the document. Alternatively or additionally, the thickened page 50 can be provided at any other page position of the document, such as, for example, in the center. The basic sequence of the method is identical here and comprises the following steps in the indicated sequence. The paper web 2 is printed, then cutting takes place in the longitudinal direction into the partial webs 4.1 to 4.4, then the partial webs 4.1 to 4.4 are guided onto one another transversely with respect to the conveying direction, then the gluing or coating with adhesive 7 takes place, followed by the partial webs 4.1 to 4.4 being guided onto one another transversely with respect to the direction of movement, then cutting of the partial webs 4.1 to 4.4 transversely with respect to the conveying direction takes place, and then the cut partial web sections are guided onto one another longitudinally with respect to the conveying direction, then optional stitching takes place, followed by folding and finally optionally cutting of the document formed in this manner.

LIST OF REFERENCE SIGNS

1 Paper reel
2 Paper web
3 Printing roller
3.1 Radial strip
3.2 Radial strip
3.3 Radial strip
3.4 Radial strip
3.11 Printing mask
3.12 Printing mask
3.13 Printing mask
3.14 Printing mask
4 Partial web
4.1 First partial web
4.2 Second partial web
4.3 Third partial web
4.4 Fourth partial web
4.5 Position
5.1 Blade
5.2 Blade
5.3 Blade
6.1 Turning rod
6.2 Turning rod
7 Adhesive
8 Glue application roller
9 Transfer roller
10 Device
12 Removal device
14 Conveying device
15 Rotary printing machine
16 Separating device
18 Guide device
20 Cutting device
22 Folding device
24 Connecting device
26 Gluing machine
28 Impression roller
30 Printing plate
32 Upper side
34 Lower side
36 Chambered doctor blade system
38 Chamber

40 Doctor blade
42 Detection device
44 Unprinted page
46 Unprinted page
48 Marking
50 Thickened page
52 Printed page
54 Printed page

The invention claimed is:

1. A method for producing documents, wherein a paper web is removed from a paper reel, said paper web is conveyed continuously, is printed using a rotary printing machine and is subsequently separated into at least two partial webs, wherein at least one first partial web is displaced in the transverse direction and is assigned to a second partial web lying thereabove or therebelow in such a manner that in each case a section of the first partial web together with a section of the second partial web form at least two sheets of the document that are subsequently cut to size, are folded longitudinally or transversely approximately centrally, are connected to one another and can be folded to form a document having at least eight pages, characterized in that at least one page of the document of the first partial web is coated at least selectively with adhesive within the region of the fold of the document and is additionally coated in at least one region outside the fold and is adhesively bonded to at least one facing page of the document of the second partial web to form a thickened page of the document, wherein the thickened page of the document has a thickness which is at least twice the size of the thickness of a non-adhesively-bonded page, wherein the adhesive is applied distributed over the entire surface of the page of the document of the first partial web, or wherein the page of the document of the first partial web and the facing page of the document of the second partial web are adhesively bonded to each other in the region of the outer edge in such a manner that the two facing pages form a pocket therebetween, or wherein individual surface regions of a page to be adhesively bonded are not coated with adhesive, and the opposite page is designed in the manner of an advent calendar with perforated window sections which can be opened manually.

2. The method as claimed in claim 1, characterized in that only one page section of the document is thickened and is formed from a page section of the document of the first partial web and a facing page section of the document of the second partial web, which page sections are adhesively bonded to each other.

3. The method as claimed in claim 1, characterized in that only one page of the document consists of adhesively bonded pages or adhesively bonded page sections.

4. The method as claimed in claim 1, characterized in that the first page and the last page of the document consist of oppositely adhesively bonded pages.

5. The method as claimed in claim 1, characterized in that, directly after the adhesive bonding process, at least one adhesively bonded page of the document is provided with a concave and/or convex embossing in the form of letterings and/or pictorial illustrations.

6. The method as claimed in claim 1, characterized in that fibrous materials are added to the adhesive.

7. The method as claimed in claim 1, characterized in that thickening fillers are added to the adhesive.

8. The method as claimed in claim 1, characterized in that the page of the document of the first partial web and the facing page of the document of the second partial web are unprinted.

9. The method as claimed in claim 1, characterized in that two consecutive pages of the document of the first partial web are coated at least selectively with adhesive and are adhesively bonded to two consecutive, facing pages of the document of the second partial web to form a thickened double page, wherein the two pages of the document of the first partial web and the two pages of the document of the second partial web are unprinted.

10. The method as claimed in claim 8, characterized in that the unprinted page of the document of the first partial web and the unprinted, facing page of the document of the second partial web are detected automatically.

11. The method as claimed in claim 10, characterized in that the unprinted page of the document of the first partial web and the unprinted, facing page of the document of the second partial web are automatically detected by means of a marking on the first partial web and the second partial web.

12. The method as claimed in claim 1, characterized in that the page of the document of the first partial web is coated with adhesive and adhesively bonded to the facing page of the document of the second partial web to form a thickened page in such a manner that the page of the document of the first partial web is immovable, in particular cannot be turned, relative to the facing page of the document of the second partial web.

13. The method as claimed in claim 1, characterized in that a total of three or more pages of the document of the first partial web and on the second partial web are adhesively bonded to one another to form a thickened page.

14. A document produced with a method as claimed in claim 1, which is produced from a paper reel, is printed, is separated into at least two partial webs and the latter are assigned to one another in such a manner that in each case a section of the first partial web together with a section of the second partial web form a plurality of sheets of a document that are cut to size, are folded longitudinally or transversely approximately centrally, are connected and are folded to form a multi-page document, characterized in that at least one page of the document of a first partial web is adhesively bonded at least selectively with adhesive within the region of the fold of the document and is additionally adhesively bonded in at least one region outside the fold to an opposite page of the document of the second partial web and forms at least one thickened page and/or a thickened page section of the document, wherein the thickened page and/or the thickened page section of the document has a thickness which is at least twice the size of the thickness of a non-adhesively-bonded page, wherein the adhesive is applied distributed over the entire surface of the page of the document of the first partial web, or wherein the page of the document of the first partial web and the facing page of the document of the second partial web are adhesively bonded to each other in the region of the outer edge in such a manner that the two facing pages form a pocket therebetween, or wherein individual surface regions of a page to be adhesively bonded are not coated with adhesive, and the opposite page is designed in the manner of an advent calendar with perforated window sections which can be opened manually.

15. A device for producing a document, comprising a removal device for removing a paper web from a paper reel a conveying device for continuously conveying the paper web a rotary printing machine for printing the paper web a separating device for separating the printed paper web into at least two partial webs, a guide device for displacing at least one first partial web in the transverse direction and for assigning the first partial web to a second partial web lying thereabove or therebelow in such a manner that in each case a section of the first partial web together with a section of the second partial web form at least two sheets of the document, a cutting device for cutting the sheets to size, a folding device for folding the sheets longitudinally or transversely approximately centrally, a connecting device for connecting the sheets to one another to form a document which can be folded with at least eight pages, characterized in that the device has at least one gluing machine which is designed for coating at least one page of the document of the first partial web at least selectively with adhesive within the region of the fold of the document and additionally in at least one region outside the fold and for adhesively bonding to at least one facing page of the document of the second partial web to form a thickened page, wherein the thickened page of the document has a thickness which is at least twice the size of the thickness of a non-adhesively-bonded page, wherein the adhesive can be applied distributed over the entire surface of the page of the document of the first partial web by means of the gluing machine, or wherein the adhesive can be applied to the page of the document of the first partial web by means of the gluing machine in such a manner that the page of the document of the first partial web and the facing page of the document of the second partial web can be adhesively bonded to each other in the region of the outer edge in such a manner that the two facing pages form a pocket therebetween, or wherein individual surface regions of a page to be adhesively bonded cannot be coated with adhesive by means of the gluing machine, and the opposite page is designed in the manner of an advent calendar with perforated window sections which can be opened manually.

16. The device as claimed in claim 15, characterized in that the gluing machine has a glue application roller which is designed for selectively loading an upper side or lower side of the first partial web with adhesive, and a transfer roller which is designed for transferring the adhesive from an adhesive source to the glue application roller in a predetermined pattern.

17. The device as claimed in claim 16, characterized in that the glue application roller has a printing plate, wherein the transfer roller is an anilox roller.

18. The device as claimed in claim 17, characterized in that the gluing machine furthermore has an impression roller, wherein the impression roller is designed for guiding the first partial web past the glue application roller in such a manner that the first partial web can be coated with adhesive by means of the glue application roller.

19. The device as claimed in claim 18, characterized in that the glue application roller and the impression roller are rotatable in an opposed manner.

20. The device as claimed in claim 19, characterized in that the gluing machine furthermore has a chambered doctor blade system with a chamber and at least one doctor blade arranged in the chamber, wherein the chambered doctor blade system is designed for applying adhesive to the transfer roller and for scraping excess adhesive from the transfer roller.

21. The device as claimed in claim 15, characterized in that the device furthermore has a detection device, wherein the detection device is designed for automatically detecting an unprinted page of the first partial web, wherein the gluing machine is designed for selectively loading the detected unprinted page of the first partial web with adhesive.

22. The use of an adhesive application method, in particular a flexographic printing method, for selectively coating at least one page of a document as claimed in claim 14 of a first partial web of a paper web with adhesive within the region of the fold of the document and additionally in at least one region outside the fold and for adhesively bonding to at least one facing page of the document as claimed in claim 14 of a second partial web of the paper web to form a thickened page of the document as claimed in claim 14 with at least eight foldable pages, wherein the thickened page of the document has a thickness which is at least twice as large as the thickness of a non-adhesively-bonded page, wherein the adhesive is applied distributed over the entire surface of the page of the document of the first partial web, or wherein the page of the document of the first partial web and the facing page of the document of the second partial web are adhesively bonded to each other in the region of the outer edge in such a manner that the two facing pages form a pocket therebetween, or wherein individual surface regions of a page to be adhesively bonded are not coated with adhesive, and the opposite page is designed in the manner of an advent calendar with perforated window sections which can be opened manually.

23. The use as claimed in claim 22, characterized in that the page of the document of the first partial web and the facing page of the document of the second partial web are unprinted.

* * * * *